US009623540B2

(12) United States Patent
Peretolchin et al.

(10) Patent No.: US 9,623,540 B2
(45) **Date of Patent: *Apr. 18, 2017**

(54) FLEXIBLE, FLAT SUBSTRATES HAVING AN ABRASIVE SURFACE

(75) Inventors: Maxim Peretolchin, Mannheim (DE); Günter Scherr, Ludwigshafen (DE); Roland Ettl, Altuβheim (DE); Volker Schädler, Ann Arbor, MI (US)

(73) Assignee: BASF SE, Ludwigshafen (DE)

( * ) Notice: Subject to any disclaimer, the term of this patent is extended or adjusted under 35 U.S.C. 154(b) by 1613 days.

This patent is subject to a terminal disclaimer.

(21) Appl. No.: 12/524,184

(22) PCT Filed: Jan. 22, 2008

(86) PCT No.: PCT/EP2008/050673

§ 371 (c)(1),
(2), (4) Date: Jul. 23, 2009

(87) PCT Pub. No.: WO2008/090136

PCT Pub. Date: Jul. 31, 2008

(65) Prior Publication Data

US 2010/0095468 A1 Apr. 22, 2010

(30) Foreign Application Priority Data

Jan. 24, 2007 (EP) ..... 07101114

(51) Int. Cl.

| | |
|---|---|
| ***B24D 3/28*** | (2006.01) |
| ***D21H 19/16*** | (2006.01) |
| ***D21H 19/26*** | (2006.01) |

(52) U.S. Cl.

CPC ..... *B24D 3/28* (2013.01); *D21H 19/16* (2013.01); *D21H 19/26* (2013.01); *Y10T 428/24355* (2015.01)

(58) Field of Classification Search

USPC ..... 442/59; 15/209.1; 428/141

See application file for complete search history.

(56) References Cited

U.S. PATENT DOCUMENTS

| | | | | |
|---|---|---|---|---|
| 5,491,022 | A * | 2/1996 | Smith | 442/50 |
| 5,498,471 | A * | 3/1996 | Hausdorf et al. | 442/142 |
| 6,713,156 | B1 | 3/2004 | Pauls et al. | |
| 7,306,842 | B2 | 12/2007 | Decher et al. | |
| 2005/0202232 | A1 | 9/2005 | Sauniere | |
| 2007/0149676 | A1* | 6/2007 | Hu et al. | 524/425 |

FOREIGN PATENT DOCUMENTS

| | | | |
|---|---|---|---|
| GB | 1536549 | A | 12/1978 |
| WO | WO-01/94436 | A2 | 12/2001 |
| WO | WO-2004/065484 | A1 | 8/2004 |
| WO | WO-2008000665 | A2 | 1/2008 |

OTHER PUBLICATIONS

U.S. Appl. No. 13/055,264, filed Jan. 21, 2011, Käsmayer, et al.

* cited by examiner

*Primary Examiner* — Lynda Salvatore
(74) *Attorney, Agent, or Firm* — Drinker Biddle & Reath LLP

(57) ABSTRACT

Flexible, sheet-like substrates having an abrasive surface, which are obtainable by applying an aqueous solution or dispersion of at least one precondensate of a heat-curable resin to the top and/or bottom of a flexible, sheet-like substrate in an amount of at least 5 to 90% by weight, based on the uncoated, dry substrate, crosslinking the precondensate and drying the treated substrate.

15 Claims, No Drawings

FLEXIBLE, FLAT SUBSTRATES HAVING AN ABRASIVE SURFACE

CROSS-REFERENCE TO RELATED APPLICATIONS

This application is a national stage application (under 35 U.S.C. §371) of PCT/EP2008/050673, filed Jan. 22, 2008, which claims benefit of European application 07101114.2, filed Jan. 24, 2007.

BACKGROUND OF THE INVENTION

The invention relates to flexible, sheet-like substrates having an abrasive surface and their use as wiping cloths for cleaning surfaces in the household and in industry.

WO 01/94436 discloses a process for the production of resilient foams based on a melamine/formaldehyde condensate. In this process, an aqueous solution or dispersion which comprises a melamine/formaldehyde precondensate, an emulsifier, a blowing agent, a curing agent and, if appropriate, customary additives is foamed by heating to 120 to 300° C. and the precondensate is crosslinked. The molar ratio of melamine to formaldehyde is greater than 1:2. It is, for example, from 1:1.0 to 1:1.9. The open-cell, flexible foams thus obtainable are used mainly for heat and sound insulation of buildings and parts of buildings, for heat and sound insulation of the interiors of vehicles and aircraft and for low-temperature insulation, for example in cold stores. The foams are also used as insulating and shock-absorbing packaging material and, owing to the great hardness of crosslinked melamine resins, for mildly abrasive cleaning, abrasive and polishing sponges.

U.S. Pat. No. 6,713,156 describes sheet-like substrates whose surface displays an abrasive effect when rubbed on other articles. Such abrasive substrates are obtained, for example, by spraying, foaming or printing polymers onto a sheet-like underlay, such as nonwovens or paper, by applying the polymers nonuniformly thereon and curing them. The curing of the polymers must take place rapidly because a nonuniform application of the polymer is responsible for the abrasive effect of the substrate. The polymer compositions used have a minimum film formation temperature (MFT) of more than −10° C. and comprise at least one polymer having a Tg of at least 0° C., in general from 20 to 105° C. The polymer composition may comprise up to 20% by weight of additives, e.g. plasticizers, crosslinking agents, starch, polyvinyl alcohol, compositions heat-curable with formaldehyde, such as melamine, urea and phenol. The amount applied is in general more than 20% by weight, preferably from 30 to 50% by weight, based on non-wovens and other porous substrates. The substrates coated nonuniformly with polymers are used, for example, as scouring cloths and as wiping cloths in the household and industry, as cosmetic wipes and as swabs for wound treatment.

US 2005/0202232 discloses products which consist of at least one sheet-like melamine foam layer and at least one reinforcing layer. Basotect® from BASF Aktiengesellschaft is mentioned as the melamine foam. Basotect® is an open-cell foam based on a melamine/formaldehyde condensate. The sheet-like melamine foam layer and the likewise sheet-like reinforcing layer comprising cellulose fibers or natural or synthetic textile fibers are bonded to one another, for example, with the aid of a hotmelt adhesive. However, depending on the type of reinforcing layer, they can also be combined directly with one another, for example by the action of heat and, if appropriate, pressure. The products thus obtainable, which have a melamine foam layer on at least one side of the sheet, are used as articles for the cleaning and care of surfaces in the household and in industry, owing to the great hardness of the melamine foam layer. These are preferably disposable articles which are disposed of after use. In general, they are cloths which have a thickness of less than 5 mm, preferably from 0.85 to 2 mm.

Glues and impregnating resins which in each case are sold as aqueous binders or powders based on condensates of urea, melamine and formaldehyde, as Kauramin® and Kaurit® from BASF Aktiengesellschaft, 67056 Ludwigshafen, are used in the furniture and construction industry for the production of board-like board-base materials, such as particle boards, plywood boards and formwork boards, cf. Technische Information Kaurit®. Papers impregnated with impregnating resins have a hard surface. Such products are present, for example, in surfaces of laminate floors or in the decoration of articles of furniture, cf. Technische Information Kauramin®.

In order to increase the wet strength of paper, for example, melamine/formaldehyde resins are added to the paper stock prior to sheet formation in the production of paper, e.g. Urecoll® K, BASF Aktiengesellschaft, 67056 Ludwigshafen. The amounts of resin present in the paper stock are, for example, about 0.5 to 1% by weight, based on dry paper stock.

Known wiping cloths, such as kitchen roll or tissue, which are intended to be disposed of after use, do not have sufficient stability, particularly in the moist state, to ensure an adequate wiping effect.

The prior EP application 06 116 165 discloses a process for the finishing of paper and paper products with at least one finishing composition, at least one finishing composition being applied in the form of a pattern to the top and/or bottom of paper or paper products. In this process, smaller amounts of finishing compositions are required in comparison with known finishing processes in order to produce papers having comparable properties. Suitable finishing compositions are, inter alia, also melamine/formaldehyde resins and urea/formaldehyde resins.

BRIEF SUMMARY OF THE INVENTION

It is the object of the invention to provide substrates having an abrasive surface for cleaning surfaces in the household and in industry.

The object is achieved, according to the invention, by flexible, sheet-like substrates having an abrasive surface, which are obtainable by applying an aqueous solution or dispersion of at least one precondensate of a heat-curable resin to the top and/or bottom of a flexible, sheet-like substrate in an amount of at least 5 to 90% by weight, based on the uncoated, dry substrate, crosslinking the precondensate and drying the treated substrate.

DETAILED DESCRIPTION OF THE INVENTION

Abrasive surface is to be understood as meaning that, on moving this surface over another surface, a rubbing or scouring effect is exerted on the other surface. While, for example, tissue papers have virtually no scouring effect during use, the substrates according to the invention, on wiping surfaces comprising glass, metal or plastic, display a scouring effect which is desired for the cleaning of these surfaces. The scouring effect is, however, far less than that of emery paper, so that the substrates according to the invention are suitable for all those applications in which only a slight scouring effect is desired for removing dirt, so that the surface of the materials wiped with the substrates according to the invention suffer virtually no damage. The products according to the invention are preferably used as disposable articles but may also be used several times—depending on the respective application.

Examples of sheet-like substrates are paper, board, cardboard, woven fabrics, knitted fabrics and nonwovens. Paper, board and cardboard can be produced from cellulose fibers of all kinds, both from natural cellulose fibers and from recovered fibers, in particular fibers from waste paper, which are frequently used as a mixture with virgin fibers. The fibers are suspended in water to give a pulp, which is drained on a wire with sheet formation. Suitable fibers for the production of the pulps are all qualities customary for this purpose in the paper industry, e.g. mechanical pulp, bleached and unbleached chemical pulp and paper stocks from all annual plants. Mechanical pulp includes, for example, groundwood, thermomechanical pulp (TMP), chemothermomechanical pulp (CTMP), pressure groundwood, semichemical pulp, high-yield pulp and refiner mechanical pulp (RMP). For example, sulfate, sulfite and soda pulps are suitable as chemical pulp. Unbleached chemical pulp, which is also referred to as unbleached craft pulp, is preferably used. Suitable annual plants for the production of paper stocks are, for example, rice, wheat, sugarcane and kenaf. The basis weight of the paper products which constitute the sheet-like substrate for the products according to the invention is, for example, from 7.5 to 500 g/m$^2$, preferably from 10 to 150 g/m$^2$, in particular from 10 to 100 g/m$^2$. Particularly preferred sheet-like substrates are tissue papers and papers which have a structured surface, for example the kitchen roll customary in the household. Such paper products have, for example, a basis weight of from 10 to 60 g/m$^2$. The sheet-like substrates used may consist of one layer or may be composed of a plurality of layers by, for example, placing the still moist layers one on top of the other immediately after production and pressing them, or adhesively bonding the already dry layers to one another with the aid of appropriate adhesives.

Woven fabrics, knitted fabrics and nonwovens, which are likewise suitable as sheet-like substrates, usually consist of textile fibers or mixtures of textile fibers. Examples of these are fibers of cotton, cellulose, hemp, wool, polyamide, such as nylon, Perlon® or polycaprolactam, polyester and polyacrylonitrile.

The thickness of the sheet-like substrates is, for example, from 0.01 to 100 mm, preferably from 0.05 to 10 mm. It is in general in the range from 0.05 to 3 mm. The sheet-like substrates are present, for example, in the form of a web or of a sheet. Such materials are flexible. They retain their flexibility even after the application and curing of a heat-curable resin, which in fact is to be applied at most in an amount such that the flexibility of the untreated substrate is just retained. Although the flexibility of the unfreeted substrate decreases owing to the application of the heat-curable resin, the amount of resin is such that rigid, inflexible structures, as are usual, for example, in furniture veneers, do not form. The paper coated according to the invention may on no account be brittle and should not break like glass on bending and on folding. Cardboard coated according to the invention is also bendable without destruction but has a substantially improved wiping effect compared with uncoated cardboard.

For the production of the flexible, sheet-like substrates having an abrasive surface, sheet-like substrates, such as nonwovens, woven fabrics, knitted fabrics, paper, board and cardboard are first treated with an aqueous solution or dispersion of a precondensate of at least one heat-curable resin. The precondensates of the heat-curable resins are selected from the group consisting of the melamine/formaldehyde precondensates, urea/formaldehyde precondensates, urea/glyoxal precondensates and phenol/formaldehyde precondensates.

It is preferable to use a precondensate of melamine and formaldehyde in which the molar ratio of melamine to formaldehyde is greater than 1:2. A precondensate of melamine and formaldehyde in which the molar ratio of melamine to formaldehyde is from 1:1.0 to 1:1.9 is preferably used as the heat-curable resin. Melamine/formaldehyde condensates may comprise, incorporated in the form of condensed units, up to 50% by weight, preferably up to 20% by weight, of other precursors of thermosetting plastics in addition to melamine and up to 50% by weight, in general up to 20% by weight, of other aldehydes in addition to formaldehyde. Suitable precursors of thermosetting plastics are, for example, alkyl- and aryl-substituted melamine, urea, urethanes, carboxamides, dicyandiamide, guanidine, sulfurylamide, sulfonamides, aliphatic amines, glycols, phenol and phenol derivatives. Acetaldehyde, propionaldehyde, isobutyraldehyde, n-butyraldehyde, trimethylolacetaldehyde, acrolein, benzaldehyde, furfurol, glyoxal, glutaraldehyde, phthalaldehyde and terephthalaldehyde may be used as aldehydes, for example for partly replacing the formaldehyde in the condensates.

The precondensates can, if appropriate, be etherified with at least one alcohol. Examples of this are monohydric $C_1$- to $C_{18}$-alcohols, such as methanol, ethanol, isopropanol, n-propanol, n-butanol, sec-butanol, isobutanol, n-pentanol, cyclopentanol, n-hexanol, cyclohexanol, n-octanol, decanol, palmityl alcohol and stearyl alcohol, polyhydric alcohols, such as glycol, diethylene glycol, glycerol, 1,4-butanediol, 1,6-hexanediol, polyethylene glycols having 3 to 20 ethylene oxide units, glycols and polyalkylene glycols endcapped at one end, 1,2-propylene glycol, 1,3-propylene glycol, polypropylene glycols, pentaerythritol and trimethyloipropane.

The preparation of heat-curable resins is part of the prior art, cf. Ullmann's Encyclopedia of Industrial Chemistry, Sixth Completely Revised Edition, Wiley-VCH Verlag GmbH Co. KgaA, Weinheim, "Amino Resins", Vol. 2, pages 537-565 (2003).

The starting material used is an aqueous solution or dispersion of a precondensate, preferably of melamine and formaldehyde. The solids concentration is, for example, from 5 to 95% by weight, preferably in the range from 10 to 70% by weight. The solution or dispersion of the precondensate generally comprises at least one curing agent. In particular cases, the curing agent customary for the condensation can also be applied separately to the sheet-like substrate. Acidic compounds which catalyze the further condensation of the heat-curable resins are usually used as curing agents. These amounts are, for example, from 0.01 to 70% by weight, preferably from 0.05 to 60% by weight, based on the resin. Suitable curing agents are, for example, inorganic and organic acids, e.g. hydrochloric acid, sulfuric acid, phosphoric acid, nitric acid, formic acid, acetic acid, oxalic acid, p-toluenesulfonic acid or amidosulfonic acid, and acid anhydrides, such as maleic anhydride or itaconic anhydride, or salts of acids with ammonia or amines and sodium hydrogen sulfate and magnesium chloride.

The aqueous solution or dispersion of a precondensate of a heat-curable resin can, if appropriate, also comprise a surfactant. For example, nonionic, anionic and cationic surfactants and mixtures of at least one nonionic and at least one anionic surfactant, mixtures of at least one nonionic and at least one cationic surfactant, mixtures of a plurality of nonionic or of a plurality of cationic or of a plurality of anionic surfactants are suitable.

All surface-active agents are suitable, for example, as surfactants. Examples of suitable nonionic surface-active substances are ethoxylated mono-, di- and trialkylphenols (degree of ethoxylation: from 3 to 50, alkyl radical: $C_3$-$C_{12}$) and ethoxylated fatty alcohols (degree of ethoxylation: from 3 to 80: alkyl radical: $C_8$-$C_{36}$). Examples of these are the Lutensol® brands of BASF AG or the Triton® brands of Union Carbide. Ethoxylated linear fatty alcohols of the general formula $$n\text{-}C_xH_{2x+1}—O(CH_2CH_2O)_y—H,$$

where x is an integer in the range from 10 to 24, preferably in the range from 12 to 20, are particularly preferred. The variable y is preferably an integer in the range from 5 to 50, particularly preferably from 8 to 40. Ethoxylated linear fatty alcohols are usually present as a mixture of different ethoxylated fatty alcohols having different degrees of ethoxylation. In the context of the present invention, the variable y is the average value (number average). Suitable nonionic surface-active substances are furthermore copolymers, in particular block copolymers, of ethylene oxide and at least one $C_3$-$C_{10}$-alkylene oxide, e.g. three-block copolymers of the formula $$RO(CH_2CH_2O)_{y1}—(BO)_{y2}\text{-}(A\text{-}O)_m—(B'O)_{y3}—(CH_2CH_2O)_{y4}R'.$$

where m is 0 or 1, A is a radical derived from an aliphatic, cycloaliphatic or aromatic diol, e.g. ethane-1,2-diyl, propane-1,3-diyl, butane-1,4-diyl, cyclohexane-1,4-diyl, cyclohexane-1,2-diyl or bis(cyclohexyl)methane-4,4'-diyl, B and B', independently of one another, are propane-1,2-diyl, butane-1,2-diyl or phenylethanyl, independently of one another, are a number from 2 to 100 and y2 and y3, independently of one another, are a number from 2 to 100, the sum y1+y2+y3+y4 preferably being in the range from 20 to 400, which corresponds to a number average molecular weight in the range from 1000 to 20 000. A is preferably ethane-1,2-diyl, propane-1,3-diyl or butane-1,4-diyl. B is preferably propane-1,2-diyl.

Fluorine-substituted polyalkylene glycols, which are commercially available under the trade name Zonyl® (DuPont), are also suitable as surface-active substances.

In addition to the nonionic surfactants, other suitable surface-active substances are anionic and cationic surfactants. They can be used alone or as a mixture. A precondition for this, however, is that they are compatible with one another, i.e. they do not give precipitates with one another. This precondition applies, for example, to mixtures of one class of compounds in each case and to mixtures of nonionic and anionic surfactants and mixtures of nonionic and cationic surfactants. Examples of suitable anionic surface-active agents are sodium laurylsulfate, sodium dodecylsulfate, sodium hexadecylsulfate and sodium dioctylsulfosuccinate.

Examples of cationic surfactants are quaternary alkylammonium salts, alkylbenzylammonium salts, such as dimethyl-$C_{12}$- to $C_{1-8}$-alkylbenzylammonium chlorides, primary, secondary and tertiary fatty amine salts, quaternary amidoamine compounds, alkylpyridinium salts, alkylimidazolinium salts and alkyloxazolinium salts.

Anionic surfactants, such as, for example, (optionally alkoxylated) alcohols which are esterified with sulfuric acid and are generally used in a form neutralized with alkali are particularly preferred. Further customary emulsifiers are, for example, sodium alkanesulfonates, sodium alkylsulfates, such as, for example, sodium laurylsulfate, sodium dodecylbenzenesulfonate, and sulfosuccinates. Furthermore, esters of phosphoric acid or of phosphorous acid and aliphatic or aromatic carboxylic acids can also be used as anionic emulsifiers. Customary emulsifiers are described in detail in the literature, cf. for example M. Ash, I. Ash, Handbook of Industrial Surfactants, Third Edition, Synapse Information Resources Inc.

The aqueous solution or dispersion of at least one precondensate may comprise the surfactants in an amount of up to 10% by weight. If it comprises a surfactant, the amounts of surfactant which are preferably present in the solution or dispersion are from 0.01 to 5% by weight.

The aqueous solution or dispersion of the precondensate can, if appropriate, comprise further customary additives, e.g. dyes, biocides, particulate, inorganic compounds, such as silica, alumina, silicon carbide, titanium dioxide, zinc oxide, calcium carbonate, marble and corundum. The mean particle diameter of the inorganic compounds is, for example, from 1 nm to 500 μm. The amount of these additives is, for example, from 0 to 100, preferably from 0 to 25, % by weight, based on the solution or dispersion. The aqueous solution or dispersion of a precondensate may also comprise at least one fragrance or perfume. If such substances are used, the amounts are, for example, from 0.1 to 5, in general from 0.2 to 1, % by weight, based on the solution or dispersion. The flexible, sheet-like substrates according to the invention are preferably free of materials which display a scouring effect when rubbed on another surface, such as, for example, silicon carbide or alumina.

The aqueous solution or dispersion of the precondensate may also comprise from 0 to 20% by weight of at least one polymeric additive. Examples of these are homo- and copolymers of N-vinylpyrrolidone, acrylamide, methacrylamide, acrylic acid, methacrylic acid and salts of acrylic acid and methacrylic acid, polyvinyl acetate, polyvinyl alcohols, polyethylenimines, polystyrene sulfonate, polystyrenesulfonic acid, polystyrene, polymers comprising butadiene incorporated in the form of polymerized units, such as copolymers of styrene and butadiene, copolymers of styrene, butadiene and acrylic acid, copolymers of styrene, acrylonitrile and butadiene, polyacrylonitrile, copolymers of acrolein, homo- and copolymers of alkyl acrylates, homo- and copolymers of alkyl methacrylates, polyamides, polyesters and polyformaldehyde.

In order to produce the products according to the invention, the solution or dispersion of the precondensate (also referred to below as "preparation solution") can be applied to the substrate either over the whole surface or in the form of a pattern. The preparation solution may also be foamed prior to the application to the sheet-like substrate, for example by stirring in air or other gases. Sheet-like substrates which are coated with a foam whose cells, in contrast to a known foam comprising a heat-curable resin based on melamine and formaldehyde, such as Basotect®, have a mean diameter in the nanometer range, e.g. from 1 to 1000 nm, are then obtained after curing and drying.

The preparation solution is preferably applied in the unfoamed state to the underlay suitable in each case. It can be applied to the sheet-like substrate, for example, by spraying, knifecoating, roll-coating, printing or with the aid of other suitable industrial apparatuses which are known to a person skilled in the art, such as, for example, a size press, a film press, an airbrush or a curtain coating unit. Noncontact methods or methods employing as little pressure as possible to the sheet-like substrate are preferably used in order to reduce the absorption of the resin into the substrate.

The application can be carried out on one side or both sides, either simultaneously or in succession. The amount of curable resin which is applied with the aid of the preparation solution to the sheet-like substrate is, for example, from 5 to 90% by weight, preferably from 10 to 80% by weight, in particular from 20 to 70% by weight, based on the basis weight of the uncoated, dry sheet-like substrate.

It is therefore substantially above the amount which is usually used for a wet strength treatment of paper by addition of a wet strength agent to a paper stock in papermaking and substantially below the amount which is used for the production of decorative sheets by coating sheet-like substrates with melamine/formaldehyde resins. The amount of precondensate applied in each case to the substrate has a decisive influence on the flexibility, softness and handle of the products according to the invention.

In addition, the distribution of the preparation solution or of the cured resin over the substrate has a considerable influence on the flexibility of the products according to the invention. The preparation solution can be applied, for example, nonuniformly to the underlay, said preparation solution, for example, covering the whole area of the underlay but not being uniformly distributed thereon. A further variation comprises printing the preparation solution in the form of a pattern on the sheet-like substrate. For example, particularly flexible products are thus obtained if the preparation solution is printed in the form of parallel strips or dots on the underlay.

After the application of the preparation solution to the sheet-like underlay, crosslinking of the heat-curable resin and drying of the sheet-like substrates provided with a coat of a precondensate of a heat-curable resin are effected, it being possible for crosslinking and drying to take place simultaneously or in succession. In an advantageous embodiment, the heat-curable resin is crosslinked in a moist atmosphere and the product is then dried. The thermal curing of the resins and the drying of the products can be carried out, for example, in the temperature range from 40 to 250° C., preferably from 50 to 200° C., particularly preferably from 80 to 140° C. The drying step can also be carried out, for example, in gas dryers or in IR dryers. The higher the temperature used in each case, the shorter the residence time of the material to be dried in the drying apparatus. If desired, the product according to the invention may also be heated at temperatures up to 300° C. after the drying. Temperatures above 300° C. can also be used for curing the resin, but the required residence times are then very short.

Flexible, sheet-like substrates which are used as wiping cloths for cleaning surfaces in the household and in industry are obtained. They are suitable in particular as abrasive wiping cloths for cleaning the surfaces of articles comprising metal, glass, porcelain, plastic and wood. The products according to the invention are suitable in particular as disposable articles but, if appropriate, can be used several times. They can be used several times especially in the case of those products according to the invention which comprise a woven fabric or nonwoven as an underlay.

The stated percentages in the examples are percentages by weight, unless evident otherwise from the context.

EXAMPLES

Preparation Solution 1

A 20% strength aqueous solution was prepared from a pulverulent precondensate of melamine and formaldehyde (Kauramin® KMT 773 (powder, BASF)) and water by initially taking demineralized water in a beaker, slowly introducing the powder and then treating the mixture for one hour with an Ultra-Turrax® which was set to the highest speed. The aqueous solution of the precondensate was then filtered over a fluted filter. 3.5 g of formic acid (100% strength) and 100 μl of a fluorine-substituted surface-active agent (Zonyl® FS 300, DuPont) were added to 30 g of this solution and the mixture was stored for 6 minutes at a temperature of 70° C. in a drying oven.

Example 1

A part of preparation solution 1 was applied with the aid of a 0.2 knifecoater to one side of a 23.8 cm×25.7 cm piece of kitchen roll (TORK (Premium) kitchen roll) having a basis weight of 53 g/m$^2$. The amount of resin which was applied was 37%, based on dry kitchen roll. In order to prevent the cloth from tearing, it was underlaid with a protective paper. The coated material was then placed on an aluminum plate and dried for 15 min at 60° C. and 90% relative humidity in a conditioning chamber. The cloth coated with the preparation solution 1 was then stored for 15 min at 70° C. in a drying oven. Thereafter, the paper was dry and crosslinked. It had a basis weight of 73 g/m$^2$.

Example 2

A 34.3 cm×24.1 cm sample of a paper having a basis weight of 36 g/m$^2$ (TORK (Universal) Wiper 320 laboratory roll) was coated on one side with preparation solution 1, dried and crosslinked by the method stated in example 1. The amount of resin applied to the underlay was 26%. The basis weight of the coated substrate was then 45 g/m$^2$.

Example 3

Preparation solution 1 was sprayed onto one side of a 34.3 cm×24.1 cm sample of a paper having a basis weight of 53 g/m$^2$ (TORK (Universal) Wiper 320 laboratory roll). The applied amount of resin was 25%, based on dry paper. The coated sample was dried and crosslinked as stated in example 1. The basis weight of this sample was 66 g/m$^2$.

Example 4

Preparation solution 1 was sprayed onto both sides of a 34.3 cm×24.1 cm sample of a paper having a basis weight of 53 g/m$^2$ (TORK (Universal) Wiper 320 laboratory roll). The amount of resin applied altogether was 51%, based on uncoated paper. The coated sample was dried and crosslinked as stated in example 1. The basis weight of the sample was then 80 g/m$^2$.

Example 5

A black paper having a basis weight of 80 g/m$^2$ was coated, dried and crosslinked by the method stated in example 1. The amount of resin applied to the paper was 35%, based on uncoated, dry paper. The surface of the paper was uniformly coated, without visible striae comprising resin. The coated, dried and crosslinked paper had a basis weight of 108 g/m$^2$.

Example 6

A paper having the dimensions 22.0 cm×16.3 cm (Legamaster eraser sheet (board cloth)) and a basis weight of 47 g/m$^2$ was coated, dried and crosslinked as stated in example 1. The amount of resin which was applied to the paper was 67%, based on uncoated, dry paper. The basis weight of the sample thus treated was 79 g/m$^2$.

Example 7

A paper having the dimensions 22.0 cm×16.3 cm (Legamaster eraser sheet (board cloth)) and a basis weight of 47 g/m$^2$ was sprayed on both sides with preparation solution 1, dried and crosslinked as described in example 4. The amount of resin applied altogether was 27%, based on uncoated, dry paper. The basis weight of the sample thus treated was 60 g/m$^2$.

The coated papers obtained according to the examples were tested for their suitability as wiping cloths and compared with commercially available, uncoated papers. For this purpose, the sample to be tested was fixed in each case to one side of a cylindrical punch having a diameter of 13 mm and a weight of 600 g with the aid of an adhesive. A panel having a surface comprising a melamine/formaldehyde resin (Resopal®) was fastened on a mechanical shaker. The surface of the panel was then soiled with a permanent marker (Permanent Marker Eding 3000). The cylindrical punch was placed on this surface, that side of the punch which was adhesively bonded to the sample to be tested resting in each case on the Resopal® panel. That part of the panel which was to be cleaned was moistened with 0.5 ml of demineralized water. The mechanical shaker operated with 20 double strokes/min with a horizontal panel deflection of 5 cm. When no cleaning of the panel was achieved after 40 strokes (removal of the marks on the panel) a new sample was adhesively bonded to the cylindrical punch and the test was continued therewith. The tests carried out and results obtained are shown in the table below.

TABLE

| Cleaning cloth produced according to | Mean value of number of strokes |
|---|---|
| Example 3 | 95 |
| Example 4 | 75 |
| Comparative examples | |
| Comparison 1: Uncoated paper according to Example 3 (TORK (Premium) kitchen roll) | >200 |
| Comparison 2: Commercial "eraser tissues" | >200 |

The Resopal® panel was coated with "Alpine Weiss" and soiled with a wax crayon. Tests were then carried out with the following cleaning cloths:

| Cleaning cloth produced according to | Mean value of number of strokes |
|---|---|
| Example 3 | 28 |
| Example 4 | 30 |

-continued

| Cleaning cloth produced according to | Mean value of number of strokes |
|---|---|
| Comparative examples | |
| Comparison 1: Uncoated paper according to Example 3 (TORK (Premium) kitchen roll) | No cleaning effect; the paper underwent defibration during the test |
| Comparison 2: Commercial "eraser tissues" | 65 |

We claim:

1. A flexible, sheet-like cleaning substrate having an abrasive surface obtained by applying an aqueous solution or dispersion of at least one precondensate of a heat-curable resin to the top and/or bottom of a flexible, sheet-like substrate in an amount of at least 5 to 90% by weight, based on the uncoated, dry substrate, crosslinking the precondensate and drying the treated substrate wherein the abrasive surface has a structure that when the abrasive surface is pushed or moved on top of another surface, the abrasive surface cleans said another surface;

wherein the heat-curable resin is a precondensate of melamine and formaldehyde in which the molar ratio of melamine to formaldehyde is greater than 1:2.

2. The flexible, sheet-like substrate according to claim 1, wherein the heat-curable resin used is a precondensate in which the molar ratio of melamine to formaldehyde is from 1:1.0 to 1:1.9.

3. The flexible, sheet-like substrate according to claim 1, wherein the substrate is selected from the group consisting of the nonwovens, woven fabrics, knitted fabrics, paper, board and cardboard.

4. The flexible, sheet-like substrate according to claim 1, wherein the substrate is paper or nonwoven comprising cellulose fibers.

5. The flexible, sheet-like substrate according to claim 1, wherein the solution or dispersion of the precondensate comprises at least one curing agent.

6. The flexible, sheet-like substrate according to claim 1, wherein the solution or dispersion of the precondensate comprises at least one surfactant.

7. The flexible, sheet-like substrate according to claim 1, wherein the solution or dispersion of the precondensate comprises from 0 to 20% by weight of at least one polymeric additive.

8. The flexible, sheet-like substrate according to claim 1, wherein the solution or dispersion of the precondensate is applied to the whole surface of the substrate.

9. A flexible, sheet-like cleaning substrate having an abrasive surface obtained by applying an aqueous solution or dispersion of at least one precondensate of a heat-curable resin to the top and/or bottom of a flexible, sheet-like substrate in an amount of at least 5 to 90% by weight, based on the uncoated, dry substrate, crosslinking the precondensate and drying the treated substrate wherein the abrasive surface has a structure that when the abrasive surface is pushed or moved on top of another surface, the abrasive surface cleans said another surface;

wherein the aqueous solution or dispersion of the precondensate is applied in the form of a pattern to the substrate.

10. The flexible, sheet-like substrate according to claim 1, wherein the substrate treated with an aqueous solution of a precondensate is cured and dried at a temperature in the range of from 50 to 250° C.

11. The flexible, sheet-like substrate according to claim 1, wherein the amount of the heat-curable resin, based on the uncoated, dry substrate, is from 5 to 90% by weight.

12. A wiping cloth for cleaning surfaces in the household and in industry which comprises the flexible, sheet-like substrate according to claim 1.

13. The flexible, sheet-like substrate according to claim 1, wherein the substrate is used for cleaning surfaces in the household or the industry.

14. A process to clean a surface which comprises moving the abrasive surface of the flexible, sheet-like substrate according to claim 1 on another surface, wherein the abrasive surface cleans said another surface.

15. The flexible, sheet-like substrate according to claim 1, wherein the substrate has a scouring effect.

* * * * *